US006754995B1

(12) United States Patent
Davis et al.

(10) Patent No.: US 6,754,995 B1
(45) Date of Patent: Jun. 29, 2004

(54) PANEL FOR FORMING ON-SITE A MULTI-FUNCTION CHANNEL FOR BEING SELF-RETAINING BETWEEN, AND BY, A PAIR OF PARALLEL, ADJACENT, AND SPACED-APART FRAMING MEMBERS WITHOUT A NEED FOR FASTENERS

(76) Inventors: Michael Shannon Davis, 109 Robbins St., Port Jefferson, NY (US) 11777; Bruce Robert Munch, 3 Nobs Hill Rd., Killington, VT (US) 05751

( * ) Notice: Subject to any disclaimer, the term of this patent is extended or adjusted under 35 U.S.C. 154(b) by 0 days.

(21) Appl. No.: 09/962,710

(22) Filed: Sep. 25, 2001

(51) Int. Cl.[7] ..... E04B 7/00

(52) U.S. Cl. ..... 52/95; 52/198; 52/105; 52/773

(58) Field of Search ..... 52/94, 95, 98, 52/90, 317, 222, 408, 475.1, 737.6, 764, 773, 731.7, 198, 199, 105

(56) References Cited

U.S. PATENT DOCUMENTS

| | | | | | |
|---|---|---|---|---|---|
| 3,035,374 | A | | 5/1962 | Allen | |
| 3,160,987 | A | | 12/1964 | Pinkley | |
| 3,683,785 | A | | 8/1972 | Grange | |
| 3,863,553 | A | | 2/1975 | Koontz | |
| 3,938,429 | A | | 2/1976 | Perry | |
| 4,069,628 | A | | 1/1978 | Kreimer | |
| 4,102,092 | A | | 7/1978 | Ward | |
| 4,125,971 | A | | 11/1978 | Ward | |
| 4,185,433 | A | * | 1/1980 | Cantrell | 52/94 |
| 4,189,878 | A | | 2/1980 | Fitzgerald | |
| 4,214,510 | A | | 7/1980 | Ward | |
| 4,265,060 | A | | 5/1981 | Woodhams | |
| 4,269,007 | A | | 5/1981 | Ward | |
| 4,406,095 | A | * | 9/1983 | Slavik | 52/95 |
| 4,446,661 | A | | 5/1984 | Jonsson et al. | |
| 4,581,861 | A | | 4/1986 | Eury | |
| 4,674,249 | A | | 6/1987 | Bennett, Jr. | |
| 4,776,262 | A | | 10/1988 | Curran | |
| 4,977,714 | A | | 12/1990 | Gregory, Jr. | |
| 5,007,216 | A | * | 4/1991 | Pearson | 52/94 |
| 5,094,054 | A | | 3/1992 | Arends | |
| 5,341,612 | A | | 8/1994 | Robbins | |
| 5,596,847 | A | | 1/1997 | Stephenson | |
| 5,600,928 | A | | 2/1997 | Hess et al. | |
| 6,346,040 | B1 | * | 2/2002 | Best | 454/260 |

* cited by examiner

*Primary Examiner*—Carl D. Friedman
*Assistant Examiner*—Naoko Slack
(74) *Attorney, Agent, or Firm*—Bernard S. Hoffman

(57) ABSTRACT

A panel for forming on-site a multi-function channel. The panel is a sheet of material that is rectangular-shaped, slightly compressible, thermally insulating, and has a pair of pre-printed channel flange fold lines that extend the entire length thereof and which form a pair of channel flanges when the sheet of material is folded perpendicularly upwardly thereon, and a trio of pre-printed soffit vent baffle panel fold lines that extend the entire width thereof and have a selected one thereof forming a soffit vent baffle panel when the sheet of material is folded perpendicularly downwardly thereon. When the pair of channel flanges are intimately abutted against a pair of parallel, adjacent, and spaced-apart framing members, the sheet of material compresses enough to provide an outward force sufficient to allow the multi-function channel to be self-restraining between, and by, the pair of parallel, adjacent, and spaced-apart framing members without a need for fasteners.

50 Claims, 16 Drawing Sheets

| PROPERTY | PRESENT INVENTION | U.S. PATENT 3,035,374 TO ALLEN | U.S. PATENT 3,160,987 TO PINKLEY | U.S. PATENT 3,683,785 TO GRANGE |
|---|---|---|---|---|
| INSULATING BOARD | YES | NO | NO | NO |
| INTEGRATED BAFFLE | YES | N/A | YES | YES |
| FULL BAY VENTING | YES | N/A | YES | YES |
| SOFFIT TO RIDGE VENTING | YES | N/A | NO | NO |
| FASTENERLESS INSTALLATION | YES | NO | NO | NO |
| BAFFLE ONLY | NO | N/A | YES | YES |
| CORRECT VENT SPACE | YES | N/A | NO | NO |
| CRUSH RESISTANT | YES | N/A | NO | NO |
| DESIGNED FOR BATTS | YES | YES | NO | NO |
| NON-DEFORMED SHAPE | RECTANGLE | MODIFIED RECTANGLE | MODIFIED RECTANGLE | MODIFIED RECTANGLE |
| DEFORMED SHAPE | U | MOUNTING FLAPS BENT | INVERTED U | U |

FIG. 1A

| PROPERTY | PRESENT INVENTION | U.S. PATENT 3,863,553 TO KOONTZ | U.S. PATENT 3,938,429 TO PERRY | U.S. PATENT 4,069,628 TO KREIMER |
|---|---|---|---|---|
| INSULATING BOARD | YES | NO | NO | NO |
| INTEGRATED BAFFLE | YES | YES | N/A | YES |
| FULL BAY VENTING | YES | YES | N/A | YES |
| SOFFIT TO RIDGE VENTING | YES | NO | N/A | YES |
| FASTENERLESS INSTALLATION | YES | NO | NO | NO |
| BAFFLE ONLY | NO | YES | N/A | NO |
| CORRECT VENT SPACE | YES | NO | N/A | NO |
| CRUSH RESISTANT | YES | NO | N/A | NO |
| DESIGNED FOR BATTS | YES | NO | N/A | YES |
| NON-DEFORMED SHAPE | RECTANGLE | MODIFIED RECTANGLE | RECTANGLE | MODIFIED RECTANGLE |
| DEFORMED SHAPE | U | MOUNTING FLAPS BENT | RECTANGLE | MOUNTING FLAPS BENT |

FIG. 1B

| PROPERTY | PRESENT INVENTION | U.S. PATENT 4,102,092 TO WARD | U.S. PATENT 4,125,971 TO WARD | U.S. PATENT 4,185,433 TO CANTRELL |
|---|---|---|---|---|
| INSULATING BOARD | YES | NO | NO | NO |
| INTEGRATED BAFFLE | YES | YES | NO | YES |
| FULL BAY VENTING | YES | NO | NO | YES |
| SOFFIT TO RIDGE VENTING | YES | NO | YES | NO |
| FASTENERLESS INSTALLATION | YES | NO | NO | NO |
| BAFFLE ONLY | NO | YES | NO | YES |
| CORRECT VENT SPACE | YES | NO | POSSIBLY | NO |
| CRUSH RESISTANT | YES | POSSIBLY | NOT GOOD | NO |
| DESIGNED FOR BATTS | YES | NO | YES | NO |
| NON-DEFORMED SHAPE | RECTANGLE | SCORED RECTANGLE | CURVED RECTANGLE | MODIFIED RECTANGLE |
| DEFORMED SHAPE | U | MODIFIED V | CURVED RECTANGLE | MOUNTING FLAPS BENT |

FIG. 1C

| PROPERTY | PRESENT INVENTION | U.S. PATENT 4,189,878 TO FITZGERALD | U.S. PATENT 4,214,510 TO FITZGERALD | U.S. PATENT 4,265,060 TO WOODHAMS |
|---|---|---|---|---|
| INSULATING BOARD | YES | NO | NO | NO |
| INTEGRATED BAFFLE | YES | YES | YES | YES |
| FULL BAY VENTING | YES | YES | NO | YES |
| SOFFIT TO RIDGE VENTING | YES | NO | NO | NO |
| FASTENERLESS INSTALLATION | YES | NO | NO | NO |
| BAFFLE ONLY | NO | YES | YES | YES |
| CORRECT VENT SPACE | YES | NO | NO | POSSIBLY |
| CRUSH RESISTANT | YES | NO | POSSIBLY | NO |
| DESIGNED FOR BATTS | YES | NO | YES | NO |
| NON-DEFORMED SHAPE | RECTANGLE | RECTANGLE | MODIFIED RECTANGLE | RECTANGLE |
| DEFORMED SHAPE | U | U | RECTANGLE TO V | INVERTED U |

FIG. 1D

| PROPERTY | PRESENT INVENTION | U.S. PATENT 4,269,007 TO WARD | U.S. PATENT 4,446,661 TO JONSSON *et al.* | U.S. PATENT 4,581,861 TO EURY |
|---|---|---|---|---|
| INSULATING BOARD | YES | NO | NO | NO |
| INTEGRATED BAFFLE | YES | NO | NO | YES |
| FULL BAY VENTING | YES | NO | SOMEWHAT | YES |
| SOFFIT TO RIDGE VENTING | YES | YES | YES | NO |
| FASTENERLESS INSTALLATION | YES | NO | DOUBTFUL | NO |
| BAFFLE ONLY | NO | NO | NO | YES |
| CORRECT VENT SPACE | YES | YES | POSSIBLY | YES |
| CRUSH RESISTANT | YES | NO | YES | NO |
| DESIGNED FOR BATTS | YES | YES | YES | NO |
| NON-DEFORMED SHAPE | RECTANGLE | BENT RECTANGLE | CORRUGATED RECTANGLE | MODIFIED RECTANGLE |
| DEFORMED SHAPE | U | MOUNTED AS SOLD | CORRUGATED RECTANGLE | INVERTED U |

FIG. 1E

| PROPERTY | PRESENT INVENTION | U.S. PATENT 4,674,249 TO BENNETT, JR. | U.S. PATENT 4,776,262 TO CURRAN | U.S. PATENT 4,977,714 TO GREGORY, JR. |
|---|---|---|---|---|
| INSULATING BOARD | YES | NO | NO | NO |
| INTEGRATED BAFFLE | YES | NO | YES | NO |
| FULL BAY VENTING | YES | YES | YES | NO |
| SOFFIT TO RIDGE VENTING | YES | N/A | NO | YES |
| FASTENERLESS INSTALLATION | YES | YES | YES | NO |
| BAFFLE ONLY | NO | NO | YES | NO |
| CORRECT VENT SPACE | YES | YES | NO | NO |
| CRUSH RESISTANT | YES | YES | MAYBE | YES |
| DESIGNED FOR BATTS | YES | NO | NO | YES |
| NON-DEFORMED SHAPE | RECTANGLE | METAL MESH | NOT SHOWN | PLEATED SHEET |
| DEFORMED SHAPE | U | METAL PIERS | BOX | MODIFIED V |

FIG. 1F

| PROPERTY | PRESENT INVENTION | U.S. PATENT 5,094,054 TO ARENDS | U.S. PATENT 5,341,612 TO ROBBINS | U.S. PATENT 5,596,847 TO STEPHENSON | U.S. PATENT 5,600,928 TO HESS *et al.* |
|---|---|---|---|---|---|
| INSULATING BOARD | YES | NO | NO | YES | NO |
| INTEGRATED BAFFLE | YES | YES | NO | NO | NO |
| FULL BAY VENTING | YES | YES | NO | ALMOST | NO |
| SOFFIT TO RIDGE VENTING | YES | NO | YES | YES | YES |
| FASTENERLESS INSTALLATION | YES | NO | NO | YES | NO |
| BAFFLE ONLY | NO | YES | NO | NO | NO |
| CORRECT VENT SPACE | YES | YES | NO | POSSIBLY | YES |
| CRUSH RESISTANT | YES | YES | YES | SOMEWHAT | YES |
| DESIGNED FOR BATTS | YES | YES | NO | YES | YES |
| NON-DEFORMED SHAPE | RECTANGLE | N/A | PREFORMED | CORRUGATED RECTANGLE | PREFORMED |
| DEFORMED SHAPE | U | METAL BOX & SCREEN | U SHAPED | CORRUGATED RECTANGLE | U SHAPED |

FIG. 1G

PANEL FOR FORMING ON-SITE A MULTI-FUNCTION CHANNEL FOR BEING SELF-RETAINING BETWEEN, AND BY, A PAIR OF PARALLEL, ADJACENT, AND SPACED-APART FRAMING MEMBERS WITHOUT A NEED FOR FASTENERS

BACKGROUND OF THE INVENTION

1. Field of the Invention

The present invention relates to a panel for forming on-site a channel. More particularly, the present invention relates to a panel for forming on-site a multi-function channel that is self-retaining between, and by, a pair of parallel, adjacent, and spaced-apart framing members without a need for fasteners.

2. Description of the Prior Art

In winter, normal household activities like doing laundry, running dishwashers, and taking showers generate moisture that can damage insulation, rafters, wood decking, underlayment, and shingles. In summer, heat buildup can cause premature aging and cracking of wood and roofing materials. The most common way to address these problems is with passive and balanced ventilation.

When a ventilation system is balanced, wind blowing over the roof ridge creates a negative pressure that draws the warm, moist air out of the attic. Replacement air enters the attic through the undereave (soffit) vents, bathing the underside of the roof, and exiting at the ridge cap. Even in the absence of wind, the natural convection action of rising warm air still maintains continuous airflow along the underside of the roof between the low intake vents and the high exhaust vents. In addition, during the winter months, by continually bathing the undersides of a roof with cold fresh air melting snow is prevented from forming ice dams over the cold eaves causing structural damage to the roof, walls, and gutters. It is a simple system that works year round with no moving parts or energy consumption consisting of two critical components, the intake vents and the exhaust vents.

Soffit or undereave vents and ridge vents for the ingress and egress of fresh ventilating air have been produced for some time and there have been a number of products that have attempted to provide an assured connection between the two.

The need for a connecting channel between soffit and ridge vents comes as a result of some common construction techniques, such as cathedral ceilings or flat roofs (roof/ceiling structures).

Typically, the roof sheathing is attached to the sloping roof rafters, an underlayment is attached to the sheathing's exterior surface, and then the roof shingles are attached to the sheathing. The roofing installers typically use nails that penetrate the roof sheathing by at least ½ inch.

When the insulation contractors follow up they press the insulation batts up into the bay formed by the roof rafters and the roof sheathing where the batts tend to hang up on the roofing nails. When the insulation batts are pulled back down to staple the insulation flanges to the underside of the rafters, the insulation snags on the roofing nails and blocks the critical flow of fresh air from the soffit vents, up under the roof sheathing, to the ridge vents. This lack of critical ventilation causes roof damage in all climates and leads to ice damming in northern climates. In an effort to prevent this situation contractors have tried a number of cures.

Among them, driving nails on the inside of each roof rafter bay, at approximately one foot intervals and around one inch from the roof sheathing, and then connecting theses nails with string to prevent the insulation from reaching the roof sheathing. Unfortunately, this is very labor intensive, not particularly effective, and provides no protection for the upper layer of insulation. This exposed upper surface of insulation will inevitably be damaged by the infiltration of moisture thereby significantly decreasing its thermal effectiveness.

The current state of the art in the area of vent channeling is a readily available product sold under the trade name RAFT-R-MATE by Owens Corning and patented as U.S. Pat. No. 5,600,928 to Hess et al. Hess et al. teach an extruded foam polystyrene sheet formed into a roof vent panel for a sloping roof at the eaves. The panel has flanges, an offset wall, and is formed into through troughs end-to-end which are divided by truncated triangular ridges extending from the offset wall. The ridge is reinforced by gussets and saddles which are formed as sets along the ridges. The gussets extend from the offset wall to the ridge side walls and the saddles connect the ridge side walls below the truncated apex of the ridge. The gussets on each side wall are spaced and paired with one of each pair at the end of a saddle.

Simply, the roof vent panel of Hess et al. consists of a very thin extruded foam polystyrene panel which is attached by perimeter staples to the underside of the roof sheathing between the roof rafters and thus creating a vent channel from the soffit vent area to the attic or ridge vents. Unfortunately, the roof vent panel of Hess et al. has the following drawbacks that are fortunately overcome by the present invention, as will be discussed infra:

First, in order to create a crush resistant ventilation channel out of the very thin foam sheet materials of Hess et al., it is necessary to incorporate molded longitudinal reinforcing channels. The size of these reinforcing channels limits the available volume of air by reducing the actual ventilation channel area and the increase in exposed surface area of the reinforcing channels also reduces the free flow of ventilating air by virtue of increased air friction or drag.

In contradistinction, the present invention's integral strength requires no air restricting, reinforcing channel(s) and thus facilitates a larger volume of ventilation air. The present invention's single, smooth surfaced ventilation cavity also improves ventilation performance by reducing frictional losses.

Simply, the present invention being constructed of a semi-rigid, compressible, smooth faced insulating panel facilitates a single full bay channel for increased volumes of airflow and decreased surface resistance to laminar airflow.

Second, Hess et al. as a single-use, channel application, cannot prevent attic insulation from intruding and blocking off the soffit cavity intake vents nor can it protect the open ends of the attic insulation nearest the soffit cavity and vents from direct or indirect moisture infiltration. Such damp or wet conditions significantly decrease the insulating values of the insulation.

In contradistinction, the present invention incorporates an integral vent baffle and insulation dam to prevent attic insulation from intruding and blocking off the soffit cavity intake vents while protecting the open ends of the attic insulation nearest the soffit cavity and vents from direct or indirect moisture infiltration. Eliminating such damp or wet conditions prevents any significant decrease in the insulating values of the insulation.

Simply, the present invention integrates the required vent baffle which prevents the insulation installer from forcing insulation into the soffit venting cavity and also provides an insulated barrier to prevent the exposed end of the attic insulation nearest the soffit vent from wind driven water.

Third, the extruded polystyrene foam roof vent panel of Hess et al. is very thin and provides no significant insulating properties.

In contradistinction, the present invention's material can attain a thermal resistance to heat loss or heat gain as high as an R-value of 5. This substantially higher insulating value of the present invention significantly augments the existing attic insulation by further reducing heat loss and heat gain from the attic, which reduces the initial size of heating and cooling equipment and also reduces expensive heating and cooling energy operating costs.

Simply, the insulating board of the present invention provides an added insulation benefit of R-3.3 or greater.

Fourth, to properly install the roof vent panel of Hess et al., the installer, while on a ladder, must press the foam roof vent panel against the underside of the roof sheathing with one hand and with the other hand staple or nail it in position at the same time. This time consuming process exposes the installer to a substantial risk of injury from falling off the ladder.

In contradistinction, the present invention being self-supporting does not require any nails, staples, or fasteners to hold it in its proper position. This significantly reduces the possibility of injury to the installer by reducing the time for installation and exposure to falling.

Simply, due to the compressive properties of the present invention's material when deformed, there are no fasteners required thus leading to a significantly faster and safer installation. The present invention is merely folded on the pre-formed flanges, slipped into the bay space between the roof rafters until the flanges meet the roof sheathing, and the compressed flanges hold it in place. Once the insulation is installed the vent channel never moves or degrades.

Fifth, the roof vent panel of Hess et al. is narrower than the rafter bay thus failing to provide an edge-to-edge space. As a result, some of the attic insulation is in physical contact with the roof sheathing thereby allowing greater heat transference to the roof surface and no fresh air ventilation to this area of sheathing.

In contradistinction, the present invention provides an edge-to-edge barrier to prevent my contact between the attic insulation and the underside of the roof sheathing thus maintaining insulation and ventilating integrity.

Simply, the present invention provides full bay, rafter to rafter venting thereby providing significantly more available ventilating air than the current state of the art.

In toto, the improved venting and insulating characteristics of the present invention provides years of savings for the homeowner while the improved speed and safety of the installation process provides significant cost savings to contractors and installers.

Numerous other innovations for building structure related devices have been provided in the prior art that will be described infra. Even though these innovations may be suitable for the specific individual purposes to which they address, they differ from the present invention in that they do not teach a panel for forming on-site a multi-function channel that is self-retaining between, and by, a pair of parallel, adjacent, and spaced-apart framing members without a need for fasteners.

FOR EXAMPLE, U.S. Pat. No. 3,035,374 to Allen teaches sill leakage preventing apparatus comprising a draft stop unit capable of installation when the framework is being erected or at any convenient time after erection has been completed. The unit is prefabricated and embodies a vertical draft blocking panel equal in being to the depth of the space between joists. The panel has a top and two end marginal flanges providing attaching flaps. The flaps are flexibly joined to the edges of the panel. The entire outside surface is covered with insulation material. The flaps extend in a direction inwardly from the outside surface and are secured to the bottom surface of the floor and adjacent cooperating surfaces of the outer ends of the joists so as to secure the insulation material between the panel and a header. The lower edge of the panel is flexibly joined to a generally horizontal apron-like extension which extends between the joists and over an inner portion of a sill. Upwardly extending flaps are connected to the sides of the extension and secured to adjacent joists. The underneath side of the extension is also covered with insulation material which extends over the sill. The free lengthwise forward edge of the extension has rigidly connected thereto a downwardly extending reinforced flange abutting an upper vertical surface portion of a foundation wall. The sill leakage preventing apparatus substantially reduces the convection of heat through the spaces between the header and sill and the conduction of heat through the header and sill and the conduction through the header and the upper portion of the masonry wall.

ANOTHER EXAMPLE, U.S. Pat. No. 3,160,987 to Pinkley teaches an insulation dam for positioning adjacent a vent in eaves of a building. The dam includes a generally rectangularly shaped flat sheet. An end tab is bent angularly relative to the flat sheet, lies in abutting sealing relation to the top of a wall plate, and spans the space between adjacent spaced roof rafters and ceiling joists. The flat sheet is inclined upwardly from the end tab and positioned between adjacent rafters and spaced below the tops thereof. Side tabs are bent angularly relative to the flat sheet. Apparatus secures the side tabs in abutting and sealing relation with the roof rafters and ceiling joists whereby the dam between the side tabs spans the space between the roof rafters and the ceiling joists.

STILL ANOTHER EXAMPLE, U.S. Pat. No. 3,683,785 to Grange teaches a roof construction designed to provide air flow along the underside of the roof deck from the facia to the ridge to thereby prevent the formation of ice dams on the roof in the winter as well as removing accumulated attic heat for summer comfort. The facia is attached to the ends of the rafters and is a dual-wall member including a front facia board and a backing member which are spaced apart to provide a series of vertically extending passages therebetween. The upper end of the backing member terminates short of the upper end of the facie board so that air flowing upwardly within the passages is directed along the underside of the roof deck and flows upwardly along the roof deck to an outlet at the ridge of the roof. Baffles are located within the spaces between adjacent rafters to insure that air flow along the underside of the roof deck is unobstructed. The baffles extend from the area of the facie to a location inwardly of the top plate on the exterior wall of the building.

YET ANOTHER EXAMPLE, U.S. Pat. No. 3,863,553 to Koontz teaches a combination ventilation baffle and insulation stop (referred to as "article") for use in building structures to provide air passage to the space between the roof and ceiling. The article may be further utilized to prevent insulation from clogging the passage or otherwise prevent free circulation of air therethrough. The article comprises a flat rectangular body having foldable side sections to facilitate mounting between roof rafters or joist members at a location adjacent the bearing plate of an outside wall. When installed, the apparatus defines an air passage between its central section and the structure roof. The passage may be selectively sealed through use of a pivotable tab during application of insulation then subsequently reopened thereby insuring proper ventilation.

STILL YET ANOTHER EXAMPLE, U.S. Pat. No. 3,938, 429 to Perry teaches a roof air vent having rails mountable about an opening in a roof for forming a support bracket for one or more perforated panels. A pair of the rails are parallel to one another for forming tracks in which the panels are inserted.

YET STILL ANOTHER EXAMPLE, U.S. Pat. No. 4,069, 628 to Kreimer teaches an eave thermal baffle for insulation adapted to be fastened on the exterior building wall and between adjacent roof framing members or other framing as may be appropriate. The baffle comprises a flat portion called the plate section adapted to lie on the top plate of the exterior wall and to be fastened thereto or placed against the exterior face of the exterior wall and to be fastened thereto. Extending vertically from this flat portion is a wall portion adapted to be fastened to the inner faces of appropriate framing members. Extending from this wall portion is a main baffle section which extends inwardly of the building and upwardly from the vertical wall. The main baffle section may also be fastened to the inner faces of a pair of appropriate framing members. Upstanding ribs extending along the sides of the main baffle section and the main baffle section serve to form a trough or channel for movement of ventilating air. The baffle prevents air and moisture from going in through the eave-soffit area or the eave construction and penetrating the insulation. The baffle assures the free movement of ventilating air into the structural cavity to assist in the removal of any moisture laden air which migrates up through the ceiling construction and to assist also in the removal of the hot air in the structural cavity caused by the "sun effect" whereby the ambient attic temperature is reduced, thereby reducing the air conditioning energy cost.

STILL YET ANOTHER EXAMPLE, U.S. Pat. No. 4,102, 092 to Ward teaches a venting device providing an air vent passage between the soffit space and attic space of a structure and a baffle for retaining insulation material in the attic. The venting device has a generally V-shaped body forming with the roof an air vent passage leading from the soffit space to the attic space. The V-shaped body is located between adjacent roof rafters with an air vent passage leading from the soffit space to the attic space. The V-shaped body is located between adjacent roof rafters with flanges on opposite sides of the body that engage the roof boards and the adjacent roof rafters. The forward end of the body has foldable baffles that close the space between the sill plate and the roof boards leaving the passage formed by the V-shaped body open so that the insulation material in the attic does not block the soffit and passage between soffit space and attic space.

YET STILL ANOTHER EXAMPLE, U.S. Pat. No. 4,125, 971 to Ward teaches a vent and baffle used to provide an air passage between the soffit and the attic of a house to insure the flow of air through the attic. The vent is an elongated arcuate member having outwardly directed flanges adapted to be secured to the roof boards of a structure with suitable fasteners. The baffle is a block having a semi-circular recess to accommodate and support the one end of the vent against the end of the roof boards. The baffle is located in a tight fit or wedged relationship with the roof boards and top plate of the structure to block the passage between the attic and the soffit and insulate the area above the top plate of the side wall of the structure. The vent and baffle are made from a foamed plastic having flame resistant additives.

STILL YET ANOTHER EXAMPLE, U.S. Pat. No. 4,185, 433 to Cantrell teaches a baffle board for use in house construction to prevent loss of blown-in insulation through the eaves and yet to provide clearance ventilation space between the baffle board and the sheathing. The baffle board is a standard construction adapted for use in truss roofs and offset roofs, and with framing members of different standard widths. A generally rectangular piece of stiff material having a plurality of both longitudinal and transverse score lines and slits for folding, forming a baffle board which is quickly shapeable for use in most standard roof constructions.

YET STILL ANOTHER EXAMPLE, U.S. Pat. No. 4,189, 878 to Fitzgerald teaches an insulation vent provided in spaced relation to the roofing boards to allow for free flow of ventilating air between the soffit and the interior of the attic above the insulating material and along the roof boards. This insulation vent is sold flat. To be installed it is folded on pre-scored crease lines, first to form an elongated trough consisting of a rectangular roof clearing sheet and two upwardly extending roof contacting spacer flanges. A lower end portion of the roof clearing sheet is folded down to become a wall sheathing contact sheet, and the flanges which fold down with it are stapled to the roof rafters to hold the roof clearing sheet and sheathing contact sheet in place. The upper end of the roof clearing sheet is folded down also on a pre-scored crease line to form a stiffener tab for the upper end portion of thereof clearing sheet and the two flanges folding down with it are stapled into the roof rafters to permanently position the stiffener tab under the upper end of the roof clearing sheet and to hold the upper end of the roof clearing sheet in position with the roof clearing sheet spacer flanges held against the roof boards.

STILL YET ANOTHER EXAMPLE, U.S. Pat. No. 4,214, 510 to Ward teaches a vent and baffle unit locatable between adjacent roof rafters of a structure to provide a passage for the flow of air from the soffit to the attic and block the normal opening between the soffit and attic. The vent and baffle unit has a vent section having a triangular base and triangular side walls. Flanges are articulately joined to the outer edges of the side walls. The vent section can be folded into a generally V-shaped configuration. The inlet to the vent section has a generally rectangular cross sectional area. The outlet has a triangular cross sectional area. The baffle is articulately connected to the front of the vent section. The baffle is folded in a downward direction to block the normal opening between the attic and the soffit. The vent and baffle unit can be folded in an inward direction to provide a narrow configuration allowing it to be used with 16" on center roof rafters. Alternatively, the vent and baffle unit can be folded in an outward direction which allows the vent and baffle unit to be used with 24" on center roof rafters.

YET STILL ANOTHER EXAMPLE, U.S. Pat. No. 4,265, 060 to Woodhams teaches temperature equalizing means for roofs. Means are provided for containing and controlling ceiling insulation so as to provide adequate air-flow communication between a first zone defined between the ceiling and the roof of a building and a second zone defined between projecting eaves of the building and soffits immediately thereunder. Such communication maintains the roof at a more nearly uniform temperature across the entire width of the roof so that during cold weather melting of snow on the roof is minimized and thereby the build-up of a ridge of ice along the eaves caused by freezing of melted snow is minimized and, consequently, leakage of melted ice under the shingles and through the roof is prevented. The device comprises a channel-shaped member positionable between the rafters of the building and spaced from the inside surface of the roof boards whereby communication between the first and second zones is not blocked by the installation of insulation on the ceiling.

STILL YET ANOTHER EXAMPLE, U.S. Pat. No. 4,269,007 to Ward teaches a vent and baffle used to provide an air passage between the soffit and the attic of a house to insure the flow of air through the attic. The vent is an elongated arcuate member having outwardly directed flanges adapted to be secured to the roof boards of a structure with suitable fasteners. A first baffle is a block having a semi-circular recess to accommodate and support the one end of the vent against the roof boards. The baffle is located in a tight fit or wedged relationship with the roof boards, adjacent roof rafters, and the top plate of the structure to block the passage below the vent between the attic and the soffit and insulate the area above the top plate of the side wall of the structure. A second baffle is used without the vent to block the entire space above the top plate between adjacent roof rafters. The vent and baffles are made from a foamed plastic having flame resistant additives.

YET STILL ANOTHER EXAMPLE, U.S. Pat. No. 4,446,661 to Jonsson et al. teaches a sheet formed as a spacer means for creating air gaps, e.g. between roofing insulation and a roof. The sheet is corrugated and is resiliently compressible transverse to the longitudinal direction of the corrugations.

STILL YET ANOTHER EXAMPLE, U.S. Pat. No. 4,581,861 to Eury teaches a baffle board for being mounted between the roof and ceiling of a room to provide ventilation along the underside of the roof and to prevent insulation between the ceiling and the roof from being disturbed by air currents. The baffle includes a sheet of stiff, relatively thin material having outwardly and longitudinally extending side tabs defined by respective perforated lines. Side tabs are adapted to be folded at substantially right angles to the sheet and fastened to the inner facing surfaces of adjacent roof rafters. The sheet also defines on one end thereof an end tab defined by score lines. An end tab is adapted to be folded back under the sheet and fastened to the top plate of the exterior wall.

YET STILL ANOTHER EXAMPLE, U.S. Pat. No. 4,674,249 to Bennett Jr. teaches a ventilated roof construction for flat roof installations that substantially decreases damage caused by roof leaks that allow water to settle into the roofing substratum and insulation. A grid or perforated plate is supported in spaced arrangement above the underlying roofing support deck and immediately beneath the exterior roofing surface to define an air passageway or air duct therein. The grid allows evaporation of moisture from the insulation layer therethrough as air circulates thereunder. A plurality of conduits leading from the grid to the exterior roofing surface provide means for vacuuming accumulated water from the interior roofing structure to avoid damage thereto, or to pump water into the interior roofing structure to extinguish fires.

STILL YET ANOTHER EXAMPLE, U.S. Pat. No. 4,776,262 to Curran teaches a filtered insulation baffle that serves as a barrier against insects and other pests entering an attic space of a building, while allowing free air to flow into the attic through the baffle. A housing is formed with closed sides and open ends and sized to fit into the area between adjacent rafters of the building. A filter is formed from a porous filter material that is sized larger than the open end of the housing and positioned in one end of the housing to allow the filter material to protrude from the housing. The baffle is positioned between the rafters with the filter material protruding into an opening between the roof deck and the plate structure of the building. The protruding filter material is then wedged into the opening such that a portion of the filter material will roll back on the end of the housing to seal the opening while allowing free air to pass through the baffle and into the attic space of the building.

YET STILL ANOTHER EXAMPLE. U.S. Pat. No. 4,977,714 to Gregory Jr. teaches a roof ventilation baffle comprising a pleated or corrugated membrane forming a plurality of air passages. The baffle is installed between the underside of the roof sheathing and the upper surface of fiberglass insulation batts, with the pleats parallel to the rafters or roof joists to provide ventilation along the underside of the roof sheathing. The ventilation baffle is also applicable to outside walls and floors over unheated or uncooled spaces. The baffle may be perforated to provide air flow between the air passages formed by the pleats and to permit any moisture trapped in the insulation to evaporate into, and be removed by, the air flow through the channels.

STILL YET ANOTHER EXAMPLE, U.S. Pat. No. 5,094,054 to Arends teaches a method and apparatus for venting building structures in the roof and floor areas, wherein a screened pan construction is secured to the underside of the roof so as to allow the filling of insulation material and the like without obstructing the flow of outside air into, and out of, the attic space between the ceiling and roof. The same screened pan is secured in the area between the subfloor and foundation of the building structure allowing air flow between the outside of the building and the area beneath the floor structure.

YET STILL ANOTHER EXAMPLE. U.S. Pat. No. 5,341,612 to Robbins teaches a baffle vent for positioning against the underside of a roof to direct air from the soffit area of the roof upwardly over the interior surface of the roof. The baffle vent is an elongated unitary structure of sheet-like material having a generally channel-shaped cross-section defining longitudinal side walls joined by a bottom wall. Attachment flanges project from the top edges of the side walls for facilitating attaching the baffle vent to the underside of the roof. An integral longitudinal reinforcing rib is provided in the bottom wall, running along a substantial length of the baffle vent and generally parallel to the side walls, to resist collapsing of the baffle vent if subjected to external forces such as from roof insulation, handling, shipping and the like. A structure is contemplated with a plurality of the reinforcing ribs spaced in an in-line orientation longitudinally of the bottom wall whereby the structure can be cut to length between adjacent ends of a pair of spaced in-line ribs.

STILL YET ANOTHER EXAMPLE, U.S. Pat. No. 5,596,847 to Stephenson teaches a baffle vent for positioning between the underside of a roof and the top edges of the roof rafters and defining a duct between the rafters and between the vent and the interior surface of the roof for directing air over the interior surface of the roof. The vent is formed by an elongated self-supporting structure of sheet-like material having a plurality of longitudinal ribs adapted for positioning onto the top edges of the roof rafters. A plurality of longitudinal troughs are formed between the ribs and define the duct between the rafters. The ribs are on eight inch centers, spacing the ribs transversely of the structure. The troughs include bottom walls spaced below the interior surface of the roof with transverse rigidifying means formed integrally with the bottom walls.

It is apparent that numerous other innovations for building structure related devices have been provided in the prior art that are adapted to be used. Furthermore, even though these innovations may be suitable for the specific individual purposes to which they address, they would not be suitable for the purposes of the present invention as heretofore described and as tabulated in FIGS. 1A–1G, which are tables comparing significant characteristics of the present invention to that of the prior art.

SUMMARY OF THE INVENTION

ACCORDINGLY, AN OBJECT of the present invention is to provide a panel for forming on-site a channel that is self-retaining between, and by, a pair of parallel, adjacent, and spaced-apart framing members without a need for fasteners that avoids the disadvantages of the prior art.

ANOTHER OBJECT of the present invention is to provide a panel for forming on-site a channel that is self-retaining between, and by, a pair of parallel, adjacent, and spaced-apart framing members without a need for fasteners that is simple to use.

BRIEFLY STATED, STILL ANOTHER OBJECT of the present invention is to provide a panel for forming on-site a multi-function channel. The panel is a sheet of material that is rectangular-shaped, slightly compressible, thermally insulating, and has a pair of pre-printed channel flange fold lines that extend the entire length thereof and which form a pair of channel flanges when the sheet of material is folded perpendicularly upwardly thereon, and a trio of pre-printed soffit vent baffle panel fold lines that extend the entire width thereof and have a selected one thereof forming a soffit vent baffle panel when the sheet of material is folded perpendicularly downwardly thereon. When the pair of channel flanges are intimately abutted against a pair of parallel, adjacent, and spaced-apart framing members the sheet of material compresses enough to provide an outward force sufficient to allow the multi-function channel to be self-restraining between, and by, the pair of parallel, adjacent, and spaced-apart framing members without a need for fasteners.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIGS. 1A–1G are tables comparing significant characteristics of the present invention to that of the prior art;

LIST OF REFERENCE NUMERALS UTILIZED IN THE DRAWING

Figure 2:
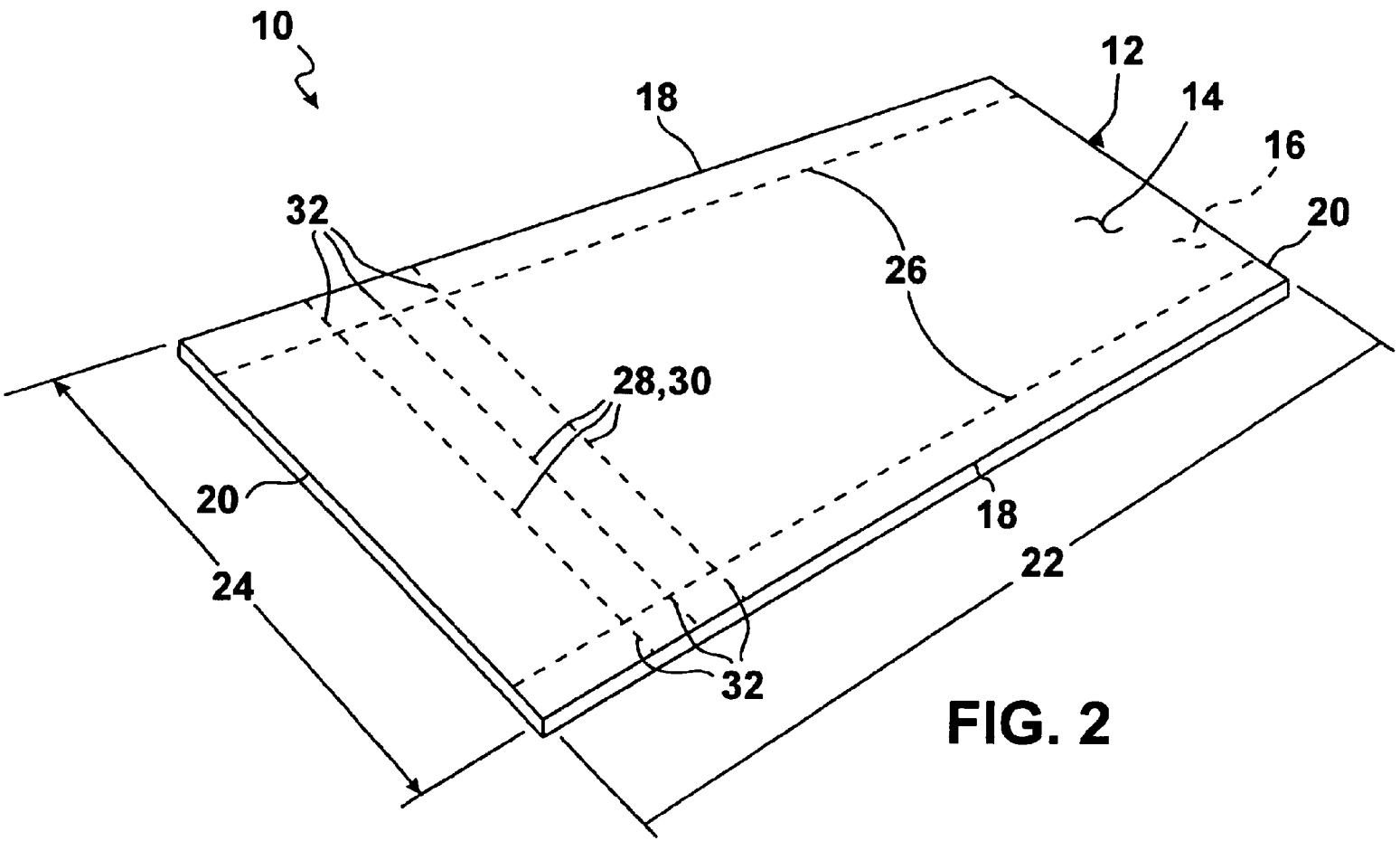
FIG. 2 is a diagrammatic perspective view of the panel of the present invention.

10 panel of present invention for forming on-site multi-function channel for being self-retaining between, and by, pair of parallel, adjacent, and spaced-apart framing members without need for fasteners
12 sheet of material
14 uppermost surface of sheet of material 12
16 lowermost surface of sheet of material 12
18 pair of long edges of sheet of material 12
20 pair of short edges of sheet of material 12
22 entire length of sheet of material 12
24 entire width of sheet of material 12
26 pair of pre-printed channel flange fold lines on uppermost surface 14 of sheet of material 12
28 plurality of pre-printed soffit vent baffle panel fold lines on uppermost surface 14 of sheet of material 12
30 trio of pre-printed soffit vent baffle panel fold lines of plurality of pre-printed soffit vent baffle panel fold lines 28 on uppermost surface 14 of sheet of material 12 for accommodating for heights of three most commonly used framing members
32 plurality of pre-printed soffit vent baffle panel cut lines on uppermost surface 14 of sheet of material 12
34 pair of upwardly foldable channel flanges of sheet of material 12
36 pair of channel flanges of multi-function channel 37
37 multi-function channel
38 web of multi-function channel 37
40 height of each channel flange of pair of channel flanges 36 of multi-function channel 37
42 pair of parallel, adjacent, and spaced-apart framing members
44 predetermined depth of multi-function channel 37
46 enclosed channel
48 planar building material
50 floor joists of pair of parallel, adjacent, and spaced-apart framing members 42
52 subflooring of planar building material 48
54 tubing/piping thermally insulated by, and contained in, enclosed channel 46 for radiant floor heating application

56 wall studs of pair of parallel, adjacent, and spaced-apart framing members 42
58 wall sheathing of planar building material 48
60 electrical wiring thermally insulated by, and contained in, enclosed channel 46 for wall application
62 pipes thermally insulated by, and contained in, enclosed channel 46 for wall application
64 ducts thermally insulated by, and contained in, enclosed channel 46 for wall application
66 modified enclosed channel
68 selected one of plurality of pre-printed soffit vent baffle panel fold lines 28
70 downwardly foldable soffit vent baffle panel
72 collinearly aligned pair of plurality of pre-printed soffit vent baffle panel cut lines 32
74 soffit vent baffle panel of multi-function channel 37 for soffit vent 76
76 soffit vent
78 pair of rafters of pair of parallel, adjacent, and spaced-apart framing members 42
80 top plate
82 roof sheathing of planar building material 48
84 height of each rafter of pair of rafters 78 of pair of parallel, adjacent, and spaced-apart framing members 42
86 pair of inwardly foldable baffle flanges of soffit vent baffle panel 74
88 pair of baffle flanges of multi-function channel 37 for abutting against pair of rafters 78 of pair of parallel, adjacent, and spaced-apart framing members 42
90 pre-printed ceiling joist/collar beam clearance cut line on uppermost surface 14 of sheet of material 12
92 first portion of pre-printed ceiling joist/collar beam clearance cut line 90 on uppermost surface 14 of sheet of material 12
94 terminal end of first portion 92 of pre-printed ceiling joist/collar beam clearance cut line 90 on uppermost surface 14 of sheet of material 12
96 innermost one of plurality of pre-printed soffit vent baffle panel fold lines 28 on uppermost surface 14 of sheet of material 12
98 adjacent ones of plurality of pre-printed soffit vent baffle panel fold lines 28 on uppermost surface 14 of sheet of material 12
100 second portion of pre-printed ceiling joist/collar beam clearance cut line 90 on uppermost surface 14 of sheet of material 12
102 adjacent one of pair of long edges 18 of sheet of material 12
104 plurality of pre-printed ceiling joist/collar beam clearance cut lines on uppermost surface 14 of sheet of material 12
106 chosen ceiling joist/collar beam cut line of plurality of pre-printed ceiling joist/collar beam clearance cut lines 104 on uppermost surface 14 of sheet of material 12
108 removable ceiling joist/collar beam clearance area of sheet of material 12
110 ceiling joist/collar beam clearance notch in sheet of material 12
112 ceiling joist/collar beam connecting pair of rafters 78 of pair of parallel, adjacent, and spaced-apart framing members 42 together
114 chosen pre-printed soffit vent baffle panel fold line 114 of plurality of pre-printed soffit vent baffle panel fold lines 28 on uppermost surface 14 of sheet of material 12
116 pre-printed ceiling joist/collar beam flange fold line on uppermost surface 14 of sheet of material 12
118 plurality of pre-printed ceiling joist/collar beam flange cut lines on uppermost surface 14 of sheet of material 12
120 chosen ceiling joist/collar beam flange cut line of plurality of pre-printed ceiling joist/collar beam flange cut lines 118 on uppermost surface 14 of sheet of material 12
122 downwardly foldable ceiling joist/collar beam flange of sheet of material 12
124 ceiling joist/collar beam flange of multi-function channel 37 for abutting against ceiling joist/collar beam 112

DETAILED DESCRIPTION OF THE PREFERRED EMBODIMENT

Referring now to the figures, in which like numerals indicate like parts, and particularly to FIG. 2, which is a diagrammatic perspective view of the panel of the present invention, the panel of the present invention is shown generally at 10 for forming on-site a multi-function channel for being self-retaining between, and by, a pair of parallel, adjacent, and spaced-apart framing members without a need for fasteners, wherein each of the pair of parallel, adjacent, and spaced-apart framing members have a height, and wherein the pair of parallel, adjacent, and spaced-apart framing members have a planar building material extending thereacross.

The panel 10 comprises a sheet of material 12 that is slightly compressible, thermal insulating, rectangular-shaped, and has an uppermost surface 14, a lowermost surface 16, a pair of long edges 18 that are straight and parallel to each other, a pair of short edges 20 that are straight, parallel to each other, shorter than the pair of long edges 18, respectively, and perpendicular to the pair of long edges 18, an entire length 22 that extends from one short edge 20 to the other short edge 20, and an entire width 24 that extends from one long edge 18 to the other long edge 18.

The uppermost surface 14 of the sheet of material 12 has a pair of pre-printed channel flange fold lines 26. The pair of pre-printed channel flange fold lines 26 are disposed inwardly the pair of long edges 18 of the sheet of material 12, respectively, are straight, are parallel to each other, and are parallel to the pair of long edges 18 of the sheet of material 12. Each pre-printed channel flange fold line 26 extends continuously from one short edge 20 to the other short edge 20 of the sheet of material 12, and optionally may be pre-grooved.

The uppermost surface 14 of the sheet of material 12 further has a plurality of pre-printed soffit vent baffle panel fold lines 28. The plurality of pre-printed soffit vent baffle panel fold lines 28 are disposed inwardly of one short edge 20 of the sheet of material 12, are straight, are parallel to each other, are parallel to the pair of short edges 20 of the sheet of material 12, and are perpendicular to the pair of long edges 18 of the sheet of material 12. Each pre-printed soffit vent baffle panel fold line 28 extends continuously from one long edge 18 to the other long edge 18 of the sheet of material 12, and optionally may be pre-scored.

The plurality of pre-printed soffit vent baffle panel fold lines 28 are a trio of pre-printed soffit vent baffle panel fold lines 30 for accommodating for the heights of the three most commonly used framing members, i.e. 8", 10", and 12".

The uppermost surface 14 of the sheet of material 12 further has a plurality of pre-printed soffit vent baffle panel cut lines 32. The plurality of pre-printed soffit vent baffle panel cut lines 32 extend along the plurality of pre-printed soffit vent baffle panel fold lines 28, from each long edge 18 of the sheet of material 12 to an adjacent pre-printed channel flange fold line 26, and optionally may be pre-cut.

The configuration and applications of the multi-function channel can best be seen in FIGS. 3–10, and as such, will be discussed with reference thereto.

Figure 3:
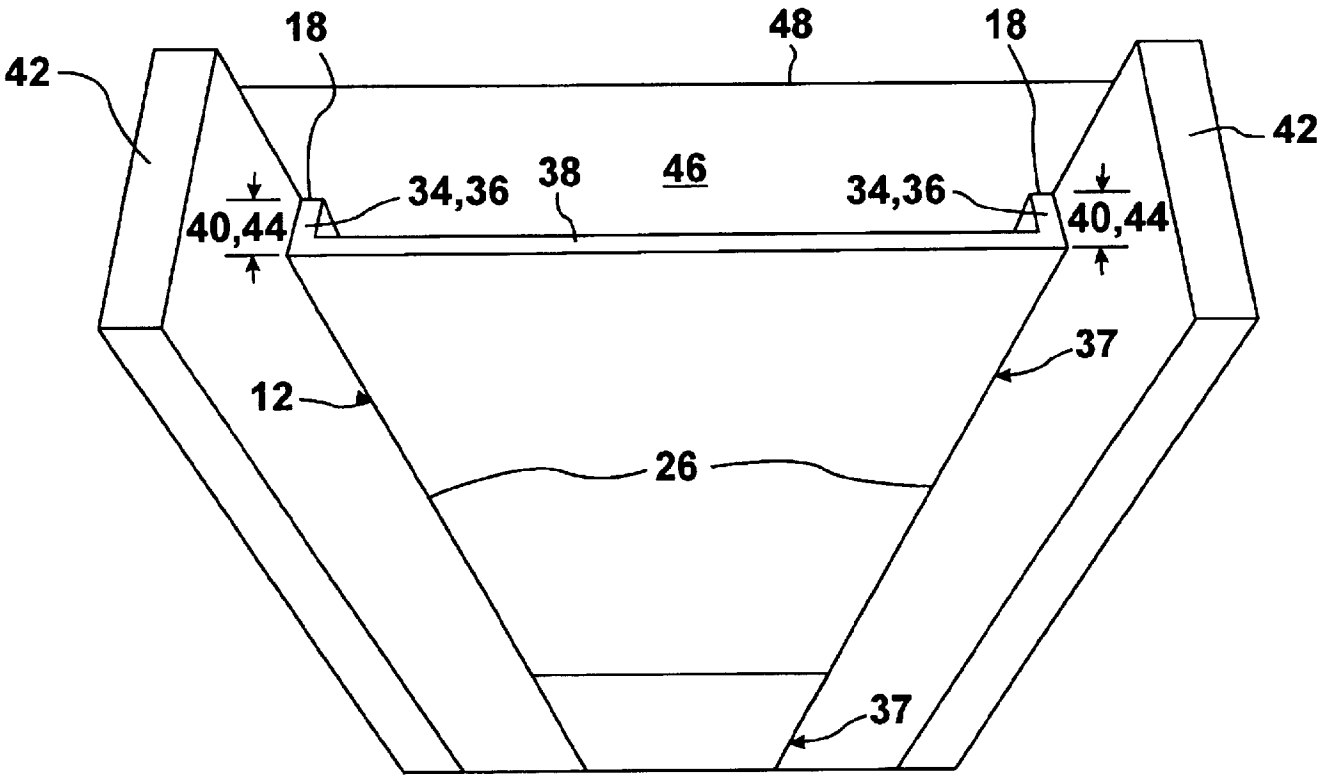
FIG. 3 is a diagrammatic perspective view of a multi-function channel formed on-site as a baffleless channel from the panel of the present invention shown in FIG. 2 and which is being self-retained between, and by, a pair of parallel, adjacent, and spaced-apart framing members without a need for fasteners.

As shown in FIG. 3, which is a diagrammatic perspective view of a multi-function channel formed on-site as a baffleless channel from the panel of the present invention shown in FIG. 2 and which is being self-retained between, and by, a pair of parallel, adjacent, and spaced-apart framing members without a need for fasteners, the pair of pre-printed channel flange fold lines 26 and the pair of long edges 18 of the sheet of material 12 define therebetween a pair of upwardly foldable channel flanges 34, which when folded perpendicularly upwardly on the pair of pre-printed channel flange fold lines 26, form a pair of channel flanges 36 of the multi-function channel 37 that are identical to each other and define a web 38 therebetween that is flat. Each channel flange 36 is rectangular-shaped, has a height 40, and extends the entire length 22 of the sheet of material 12.

When the pair of channel flanges 36 are intimately abutted against the pair of parallel, adjacent, and spaced-apart framing members 42, the sheet of material 12 compresses enough to provide an outward force sufficient to allow the multi-function channel 37 to be self-restraining between, and by, the pair of parallel, adjacent, and spaced-apart framing members 42 without the need for the fasteners, while allowing the multi-function channel 37 to extend completely from one framing member 42 to the other framing member 42, have a predetermined depth 44 determined by the height 40 of each channel flange 36, be abutted end-to-end for accommodating any desired length, and be formed into an enclosed channel 46 by the planar building material 48.

Figure 4:
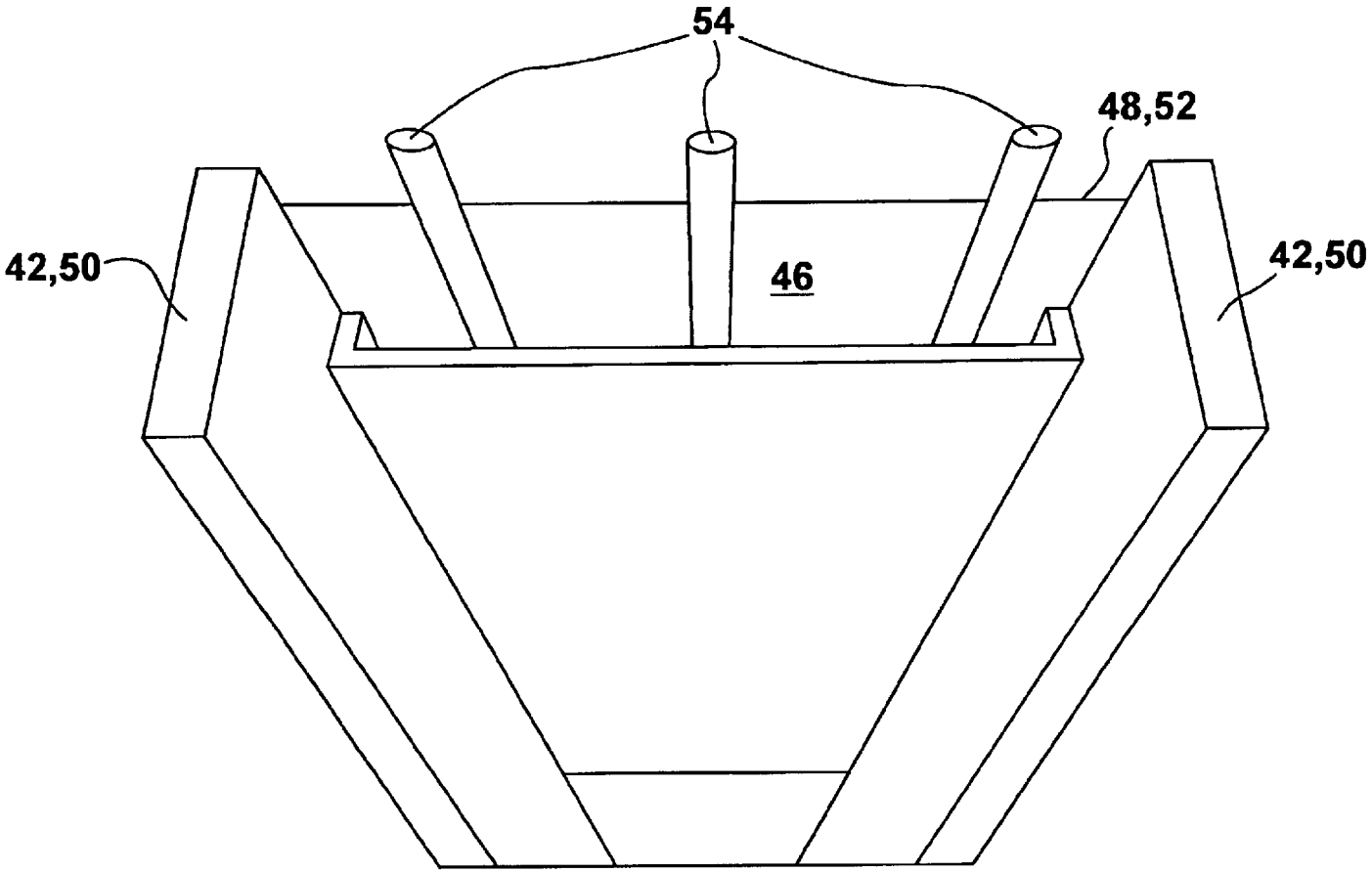
FIG. 4 is a diagrammatic perspective view of the baffleless channel shown in FIG. 3 thermally insulating, and containing, tubing/piping for radiant floor heating application.

As shown in FIG. 4, which is a diagrammatic perspective view of the baffleless channel shown in FIG. 3 thermally insulating, and containing, tubing/piping for radiant floor heating application, when the pair of parallel, adjacent, and spaced-apart framing members 42 are floor joists 50 and the planar building material 48 is subflooring 52, the enclosed channel 46 is used to thermally insulate, and contain, tubing/piping 54 for radiant floor heating application.

Figure 5:
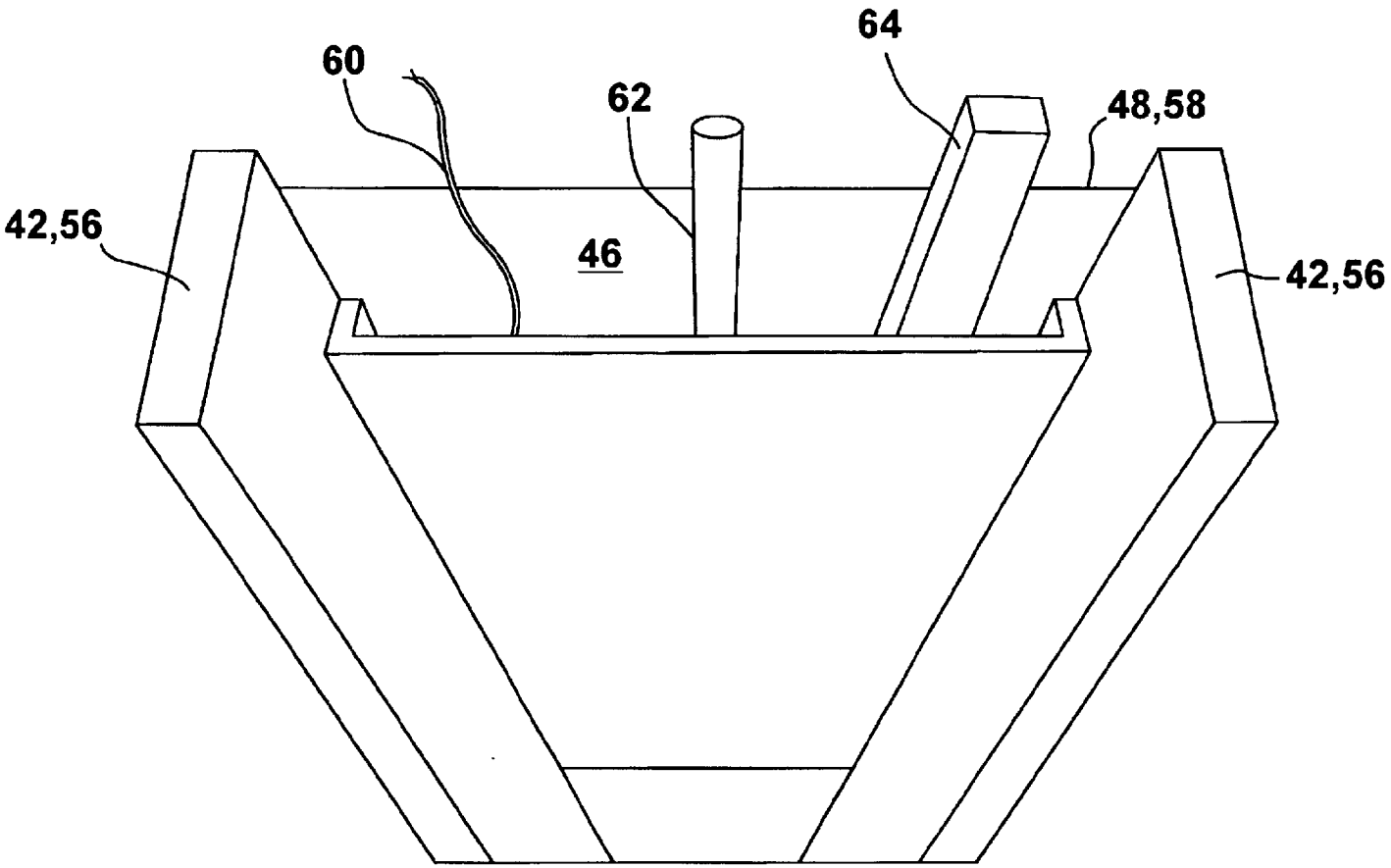
FIG. 5 is a diagrammatic perspective view of the baffleless channel shown in FIG. 3 forming a fire break and thermally insulating, and containing, electrical wiring, pipes, and ducts for wall application.

As shown in FIG. 5, which is a diagrammatic perspective view of the baffleless channel shown in FIG. 3 forming a fire break and thermally insulating, and containing, electrical wiring, pipes, and ducts for wall application, when the pair of parallel, adjacent, and spaced-apart framing members 42 are wall studs 56 and the planar building material 48 is wall sheathing 58, the enclosed channel 46 is used to form a fire break and thermally insulate, and contain, electrical wiring 60, pipes 62, and ducts 64.

Figure 6:
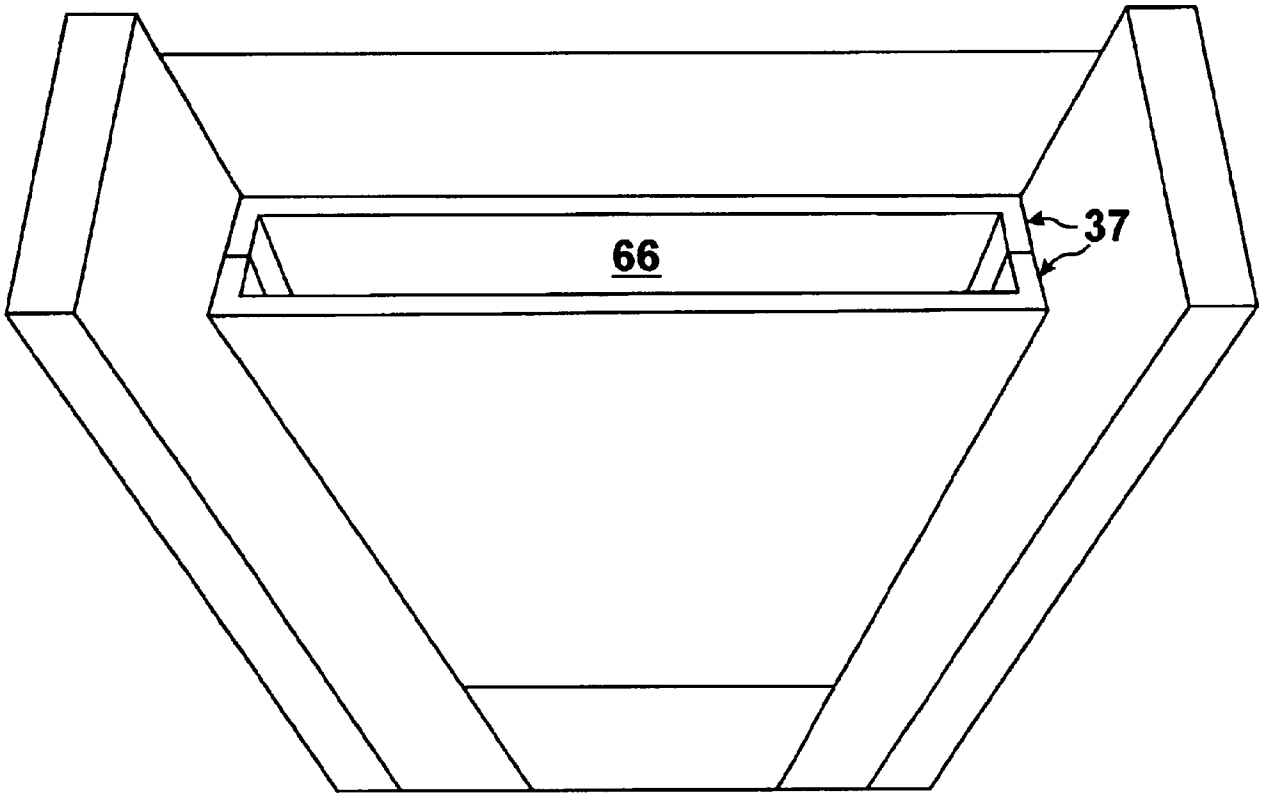
FIG. 6 is a diagrammatic perspective view of a pair of the baffleless channels shown in FIG. 3 forming an enclosed channel.

As shown in FIG. 6, which is a diagrammatic perspective view of a pair of the baffleless channels shown in FIG. 3 forming an enclosed channel, alternatively, a modified enclosed channel 66 is formed by positioning a pair of the multi-function channels 37 face-to-face.

Figure 7:
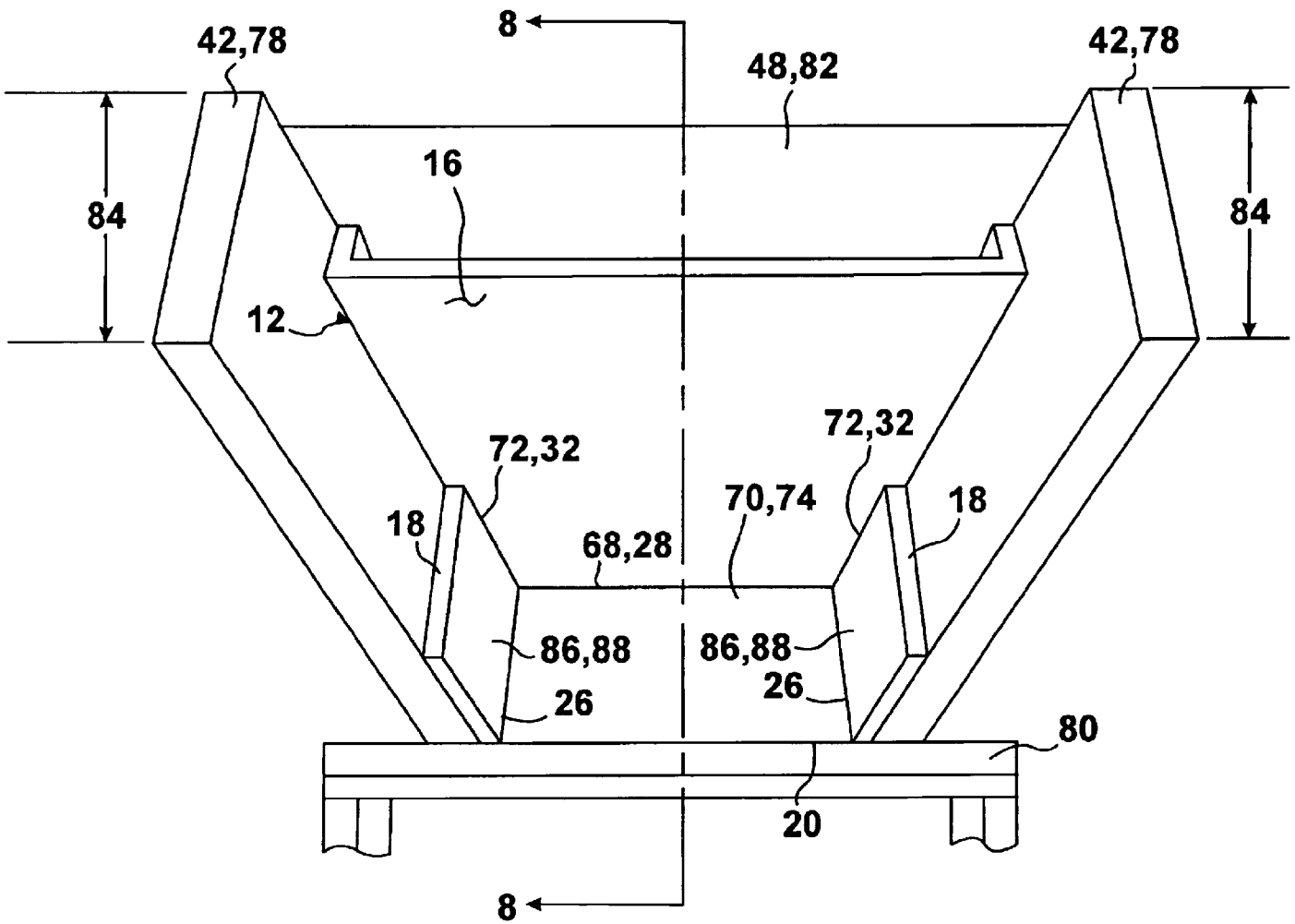
FIG. 7 is a diagrammatic perspective view of a multi-function channel formed on-site as a baffled channel from the panel of the present invention shown in FIG. 2 and which is being self-retained between, and by, a pair of parallel, adjacent, and spaced-apart framing members without a need for fasteners.
Figure 8:
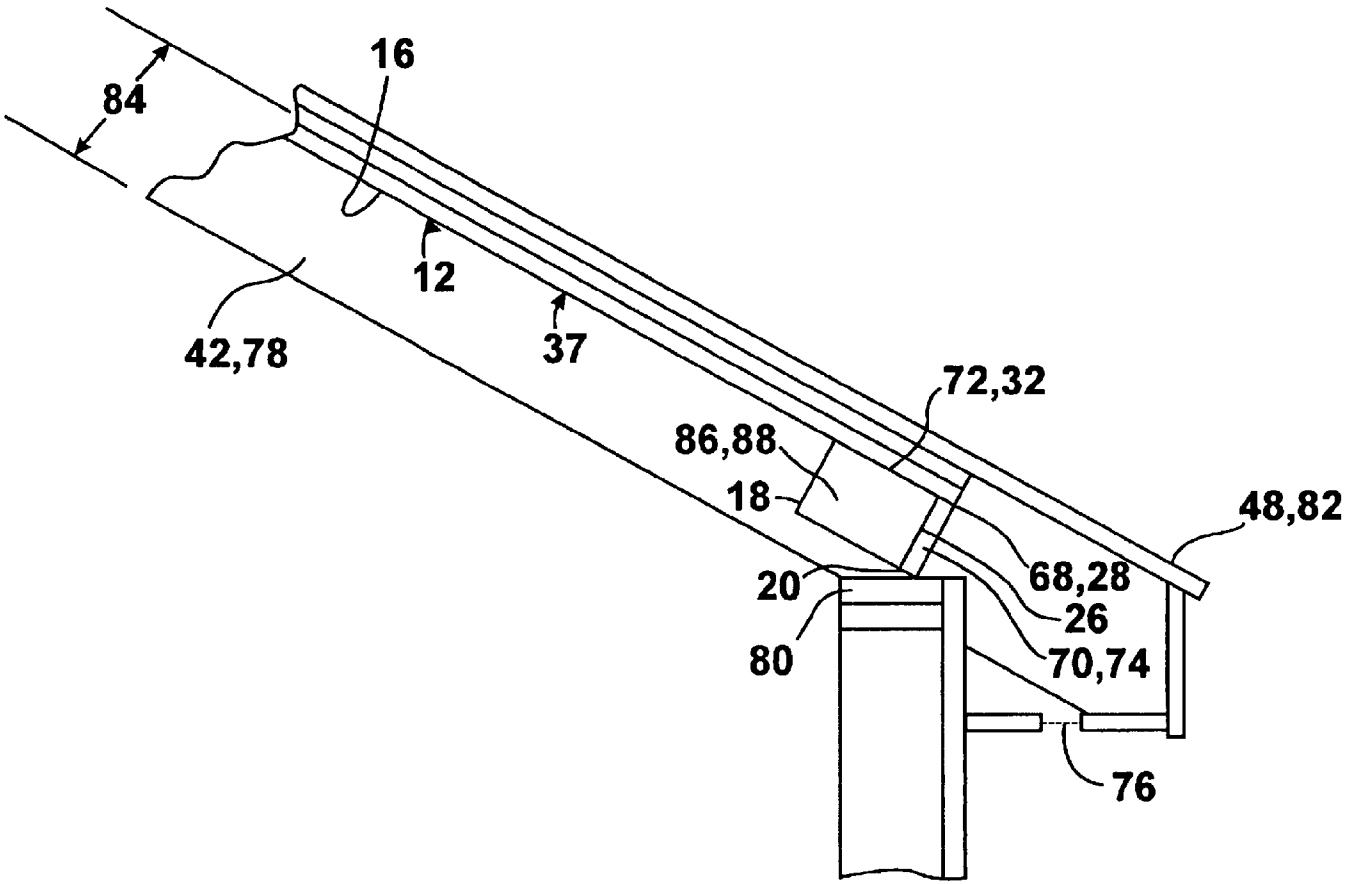
FIG. 8 is a diagrammatic cross sectional view taken along LINE 8—8 in FIG. 7.

As shown in FIGS. 7 and 8, which are, respectively, a diagrammatic perspective view of a multi-function channel formed on-site as a baffled channel from the panel of the present invention shown in FIG. 2 and which is being self-retained between, and by, a pair of parallel, adjacent, and spaced-apart framing members without a need for fasteners, and a diagrammatic cross sectional view taken along LINE 8—8 in FIG. 7, a selected one 68 of the plurality of pre-printed soffit vent baffle panel fold lines 28 and the one short edge 20 of the sheet of material 12 define therebetween a downwardly foldable soffit vent baffle panel 70.

When a collinearly aligned pair 72 of the plurality of pre-printed soffit vent baffle panel cut lines 32 are cut and the downwardly foldable soffit vent baffle panel 70 is folded perpendicularly downwardly on the selected one 68 of the plurality of pre-printed soffit vent baffle panel fold lines 28, a soffit vent baffle panel 74 of the multi-function channel 37 for a soffit vent 76 is formed when needed for use when the pair of parallel, adjacent, and spaced-apart framing 42 are a pair of rafters 78 that rest on a top plate 80 and the planar building material 48 is roof sheathing 82. The soffit vent baffle panel 74 is rectangular-shaped and extends the entire width 24 of the sheet of material 12.

The selected one 68 of the plurality of pre-printed soffit vent baffle panel fold lines 28 is chosen depending upon the height 84 of each rafter 78 for allowing the soffit vent baffle panel 74 to contact the top plate 80 and provide a complete baffle for preventing insulation between the pair of rafters 78 from intruding and blocking off the soffit vent 76 and for protecting the end of the insulation from moisture intrusion.

The soffit vent baffle panel 74 has a pair of inwardly foldable baffle flanges 86 that are defined by the pair of long edges 18 of the sheet of material 12 and the pair of pre-printed channel flange fold lines 26. When the pair of inwardly foldable baffle flanges 86 are folded perpendicularly inwardly on the pair of pre-printed channel flange fold lines 26, a pair of baffle flanges 88 of the multi-function channel 37 are formed that are for abutting against the pair of rafters 78. The pair of baffle flanges 88 further abut against the lowermost surface 16 of the sheet of material 12, and in doing so, form an automatic fold stop for the soffit vent baffle panel 74.

Figure 9:
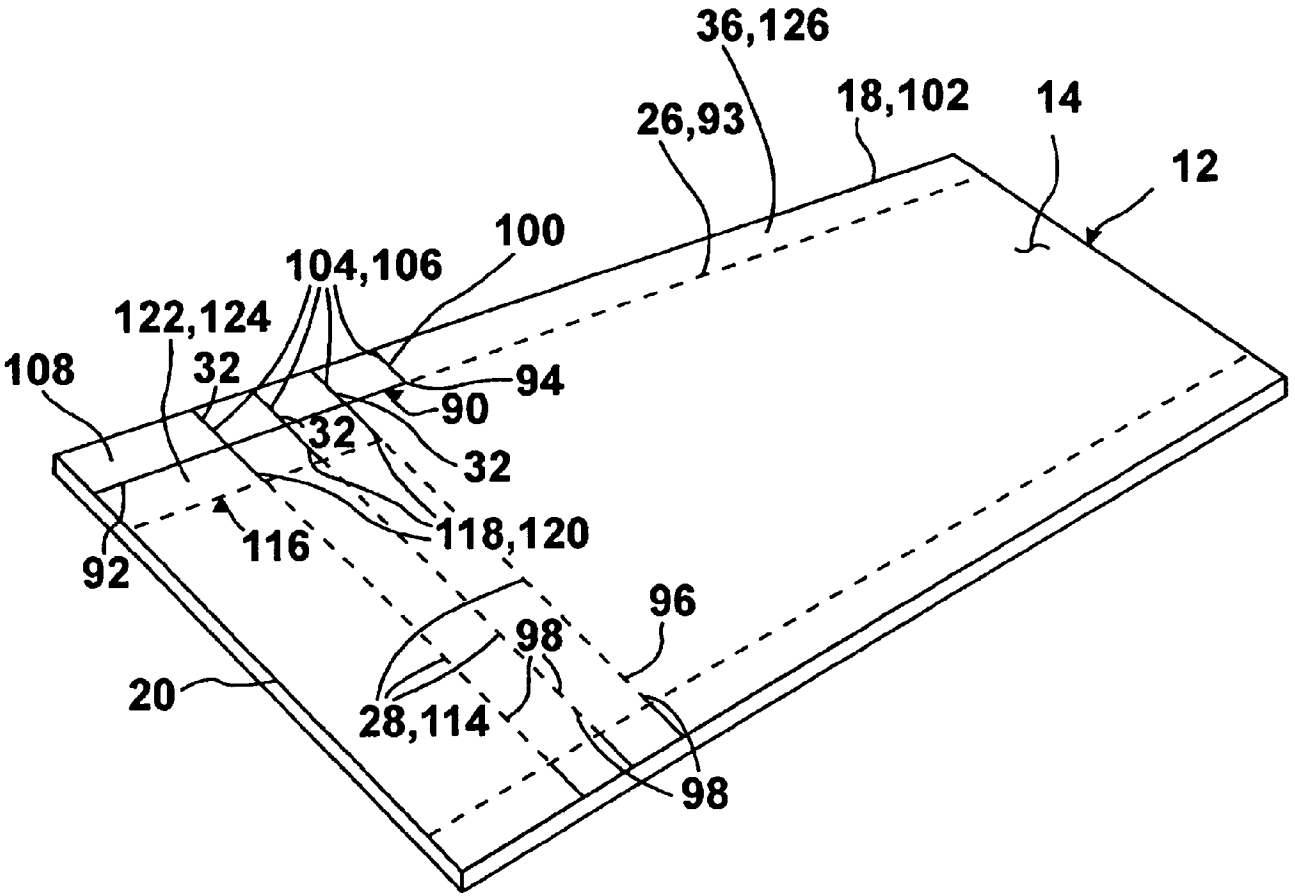
FIG. 9 is a diagrammatic perspective view of an alternate embodiment of the panel of the present invention.
Figure 9A:
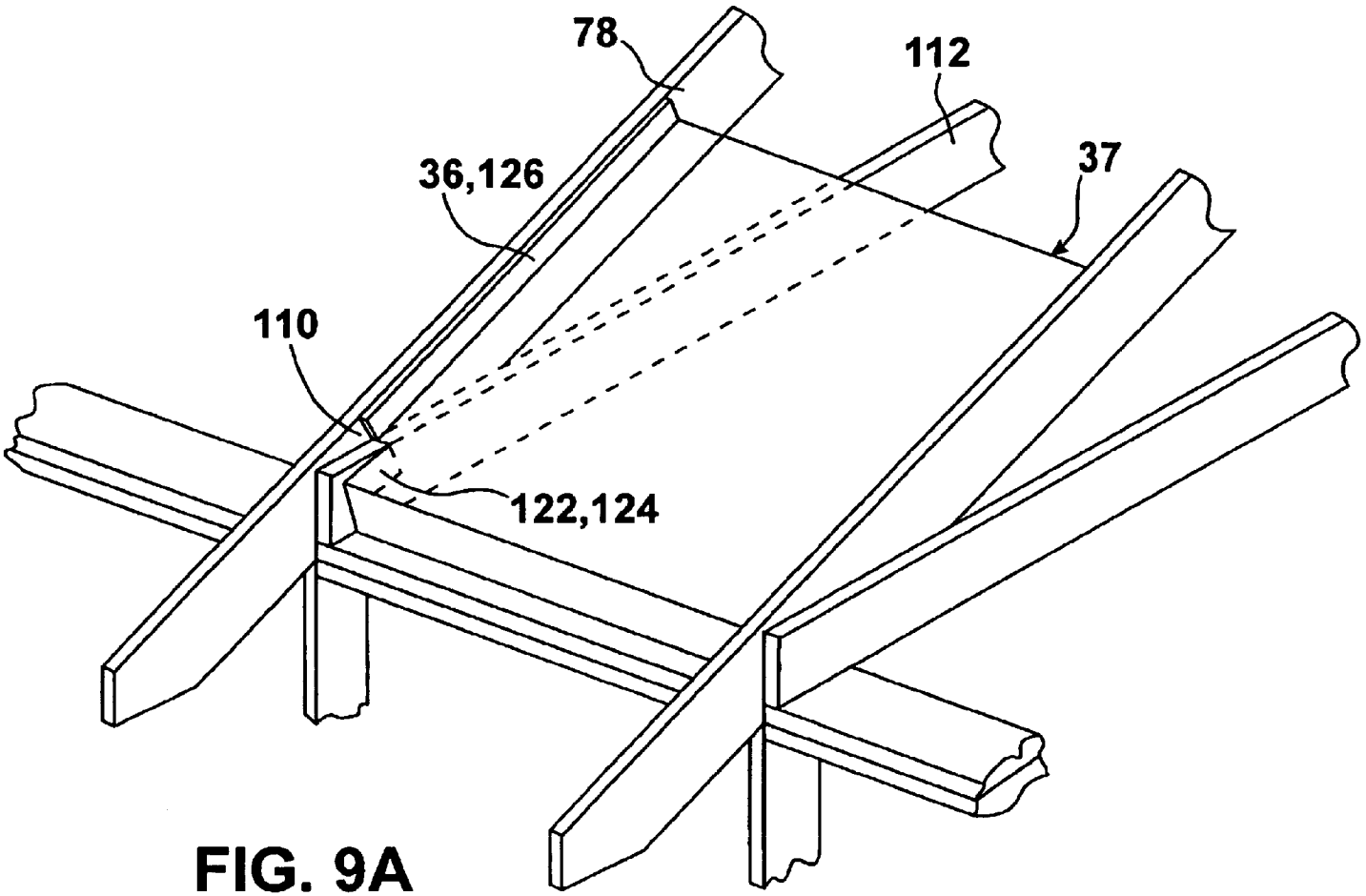
FIG. 9A is a diagrammatic perspective view of a multi-function channel formed on-site as a baffled channel for ceiling joist/collar beam application from the alternate embodiment of the panel of the present invention shown in FIG. 9, and which is being self-retained between, and by, a pair of parallel, adjacent, and spaced-apart framing members without a need for fasteners, and which accommodates for a ceiling joist/collar beam connecting the pair of parallel, adjacent, and spaced-apart framing members together.

As shown in FIGS. 9 and 9A, which are, respectively, a diagrammatic perspective view of an alternate embodiment of the panel of the present invention, and a diagrammatic perspective view of a multi-function channel formed on-site as a baffled channel for ceiling joist/collar beam application from the alternate embodiment of the panel of the present invention shown in FIG. 9, and which is being self-retained between, and by, a pair of parallel, adjacent, and spaced-apart framing members without a need for fasteners, and which accommodates for a ceiling joist/collar beam connecting the pair of parallel, adjacent, and spaced-apart framing members together, the uppermost surface 14 of the sheet of material 12 further has a pre-printed ceiling joist/collar beam clearance cut line 90.

The pre-printed ceiling joist/collar beam clearance cut line 90 has a first portion 92 that extends along an appropriate one 93 of the pair of pre-printed channel flange fold lines 26, from the one short edge 20 of the sheet of material 12 to a terminal end 94 that is disposed past an innermost one 96 of the plurality of pre-printed soffit vent baffle panel fold lines 28, a distance equal to that between adjacent ones 98 of the plurality of pre-printed soffit vent baffle panel fold lines 28, and a second portion 100 that extends perpendicularly outwardly from the terminal end 94 of the first portion of the pre-printed ceiling joist/collar beam clearance cut line 90 to an adjacent one 102 of the pair of long edges 18 of the sheet of material 12, and optionally may be pre-cut, and together with associated ones of the plurality of pre-printed soffit vent baffle panel cut lines 32 form a plurality of pre-printed ceiling joist/collar beam clearance cut lines 104 that are parallel to each other.

The first portion 92 of the pre-printed ceiling joist/collar beam clearance cut line 90, the adjacent one 102 of the pair of long edges 18 of the sheet of material 12, the one short edge 20 of the sheet of material 12, and a selected one of the plurality of ceiling joist/collar beam clearance cut lines 104 so as to form a chosen ceiling joist/collar beam cut line 106, define therebetween, a removable ceiling joist/collar beam clearance area 108 which when removed provides a ceiling joist/collar beam clearance notch 110 that is rectangular-shaped and is for providing clearance for a ceiling joist/collar beam 112.

The chosen ceiling joist/collar beam cut line 106 is chosen depending upon which of the plurality of pre-printed soffit vent baffle panel fold lines 28 is chosen so as to form a chosen pre-printed soffit vent baffle panel fold line 114, and is the ceiling joist/collar beam clearance cut line 104 that is next inwardly to the chosen pre-printed soffit vent baffle panel fold line 114.

The uppermost surface 14 of the sheet of material 12 further has a pre-printed ceiling joist/collar beam flange fold line 116. The pre-printed ceiling joist/collar beam flange fold line 116 is disposed inwardly of, and is parallel to, the first portion 92 of the pre-printed ceiling joist/collar beam clearance cut line 90, and extends from the one short edge 20 of the sheet of material 12 to the innermost one 96 of the plurality of pre-printed soffit vent baffle panel fold lines 28, and optionally may be pre-grooved.

The uppermost surface 14 of the sheet of material 12 further has a plurality of pre-printed ceiling joist/collar beam flange cut lines 118. The plurality of pre-printed ceiling joist/collar beam flange cut lines 118 are disposed along the plurality of pre-printed soffit vent baffle panel fold lines 28, respectively, and extend perpendicularly outwardly from the pre-printed ceiling joist/collar beam flange fold line 116 to associated ones of the plurality of pre-printed soffit vent baffle panel cut lines 32, respectively.

The first portion 92 of the pre-printed ceiling joist/collar beam clearance cut line 90, the one short edge 20 of the sheet of material 12, the pre-printed ceiling joist/collar beam flange fold line 116, and a selected one of the plurality of pre-printed ceiling joist/collar beam flange cut lines 118 so as to form a chosen ceiling joist/collar beam flange cut line 120 together define a downwardly foldable ceiling joist/collar beam flange 122. The chosen ceiling joist/collar beam flange cut line 120 is the ceiling joist/collar beam flange cut line 118 that is adjacently outward of the chosen ceiling joist/collar beam cut line 106.

When the removable ceiling joist/collar beam clearance area 108 is removed and the chosen ceiling joist/collar beam flange cut line 120 is cut and the downwardly foldable ceiling joist/collar beam flange 122 is folded perpendicularly downwardly on the pre-printed ceiling joist/collar beam flange fold line 116, a ceiling joist/collar beam flange 124 of the multi-function channel 37 is formed which is for abutting against the ceiling joist/collar beam 112 while the ceiling joist/collar beam clearance notch 110 provides clearance for an associated one 126 of the pair of channel flanges 36 of the multi-function channel 37.

It will be understood that each of the elements described above, or two or more together, may also find a useful application in other types of constructions differing from the types described above.

While the invention has been illustrated and described as embodied in a panel for forming on-site a multi-function channel for being self-retaining between, and by, a pair of parallel, adjacent, and spaced-apart framing members without a need for fasteners, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A panel for forming on-site a multi-function channel for being self-retaining between, and by, a pair of adjacent, and spaced-apart framing members without a need for fasteners, said panel comprising:

a sheet of material;

wherein said sheet of material has an uppermost surface;

wherein said uppermost surface of said sheet of material has a pair of channel flange fold lines;

wherein each channel flange fold line extends longitudinally along said sheet of material;

wherein said pair of channel flange fold lines are disposed inwardly of a pair of longitudinal edges of said sheet of material, respectively;

wherein said sheet of material is slightly compressible;

wherein said pair of channel flange fold lines and said pair of longitudinal edges of said sheet of material define therebetween a pair of upwardly foldable channel flanges;

wherein said pair of upwardly foldable channel flanges when folded upwardly on said pair of channel flange fold lines form a pair of channel flanges of said multi-function channel; and wherein said pair of channel flanges have outer surfaces whereby said outer surfaces of said pair of channel flanges are substantially perpendicular to said uppermost surface and are for being abutted against the pair of adjacent, and spaced-apart framing members, and when said pair of channel flanges are abutted against the pair of adjacent, and spaced-apart framing members, said sheet of material compresses enough to provide an outward force sufficient to allow said multi-function channel to be self-retaining between, and by, the pair of adjacent, and spaced-apart framing members without the need for the fasteners.

2. The panel as defined in claim 1, wherein said sheet of material has a pair of longitudinal edges; and wherein said sheet of material has a pair of lateral edges.

3. The panel as defined in claim 2, wherein said sheet of material is rectangular-shaped;

wherein said pair of longitudinal edges of said sheet of material are parallel to each other;

wherein said pair of longitudinal edges of said sheet of material are straight;

wherein said pair of lateral edges of said sheet of material are parallel to each other;

wherein said pair of lateral edges of said sheet of material are straight; and wherein said pair of longitudinal edges of said sheet of material are perpendicular to said pair of lateral edges of said sheet of material.

4. The panel as defined in claim 2, wherein said pair of channel flange fold lines are straight;

wherein said pair of channel flange fold lines are parallel to each other; and wherein said pair of channel flange fold lines are parallel to said pair of longitudinal edges of said sheet of material.

5. The multi-function channel as defined in claim 2, wherein said uppermost surface of said sheet of material has at least one soffit vent baffle panel fold line;

wherein said at least one soffit vent baffle panel fold line extends laterally across said sheet of material; and wherein said at least one soffit vent baffle panel fold line is disposed inwardly of one lateral edge of said sheet of material.

6. The multi-function channel as defined in claim 5, wherein said uppermost surface of said sheet of material has a soffit vent baffle panel cut line; and wherein said soffit vent baffle panel cut line extends along said at least one soffit vent baffle panel fold line from each longitudinal edge of said sheet of material to an adjacent channel flange fold line.

7. The panel as defined in claim 6, wherein said of at least one soffit vent baffle panel fold line and said one lateral edge of said sheet of material define therebetween a downwardly foldable soffit vent baffle panel; and wherein said soffit vent baffle panel cut line when cut and said downwardly foldable soffit vent baffle panel is folded perpendicularly downwardly on said at least one soffit vent baffle panel fold line, a soffit vent baffle panel of the multi-function channel for a soffit vent is formed.

8. The panel as defined in claim 7, wherein said soffit vent baffle panel is rectangular-shaped.

9. The panel as defined in claim 7, wherein said sheet of material has an entire width;

wherein said entire width extends from one longitudinal edge to the other longitudinal edge of said sheet of material; and wherein said soffit vent baffle panel extends said entire width of said sheet of material.

10. The panel as defined in claim 7, wherein said sheet of material has a lowermost surface;

wherein said soffit vent baffle panel has a pair of inwardly foldable baffle flanges;

wherein said pair of inwardly foldable baffle flanges are defined by said pair of longitudinal edges of said sheet of material and said pair of channel flange fold lines;

wherein said pair of inwardly foldable baffle flanges when folded perpendicularly inwardly on said pair of channel flange fold lines form a pair of baffle flanges of said multi-function channel;

wherein said pair of baffle flanges abut against said lowermost surface of said sheet of material;

wherein said pair of baffle flanges form an automatic fold stop for said soffit vent baffle panel; and wherein said pair of baffle flanges are for abutting against the pair of adjacent and spaced-apart framing members.

11. The panel as defined in claim 7, wherein said uppermost surface of said sheet of material has a ceiling joist/collar beam clearance cut line;

wherein said ceiling joist/collar beam clearance cut line has a first portion;

wherein said first portion of said ceiling joist/collar beam clearance cut line is disposed along an appropriate one of said pair of channel flange fold lines;

wherein said first portion of said ceiling joist/collar beam clearance cut line extends from said one lateral edge of said sheet of material to a terminal end;

wherein said terminal end of said first portion of said ceiling joist/collar beam clearance cut line is disposed inwardly past said at least one soffit vent baffle panel fold line;

wherein said ceiling joist/collar beam clearance cut line has a second portion;

wherein said second portion of said ceiling joist/collar beam clearance cut line extends perpendicularly outwardly from said terminal end of said first portion of said ceiling joist/collar beam clearance cut line to an adjacent one of said pair of longitudinal edges of said sheet of material; and wherein said second portion of said ceiling joist/collar beam clearance cut line together with said at least one soffit vent baffle panel cut line form a ceiling joist/collar beam clearance cut line.

12. The panel as defined in claim 11, wherein said first portion of said ceiling joist/collar beam clearance cut line, said adjacent one of said pair of longitudinal edges of said sheet of material, said one lateral edge of said sheet of material, and said ceiling joist/collar beam clearance cut line define therebetween a removable ceiling joist/collar beam clearance area;

wherein said removable ceiling joist/collar beam clearance area when removed provides a ceiling joist/collar beam clearance notch; and wherein said ceiling joist/collar beam clearance notch is for providing clearance for a ceiling joist/collar beam.

13. The panel as defined in claim 12, wherein said uppermost surface of said sheet of material has a ceiling joist/collar beam flange fold line;

wherein said ceiling joist/collar beam flange fold line is disposed inwardly of said first portion of said ceiling joist/collar beam clearance cut line;

wherein said ceiling joist/collar beam flange fold line extends from said one lateral edge of said sheet of material to said at least one soffit vent baffle panel fold line; and wherein said ceiling joist/collar beam flange fold line is parallel to said first portion of said ceiling joist/collar beam clearance cut line.

14. The panel as defined in claim 13, wherein said uppermost surface of said sheet of material has a ceiling joist/collar beam flange cut line;

wherein said ceiling joist/collar beam flange cut line is disposed along said at least one soffit vent baffle panel fold line; and wherein said ceiling joist/collar beam flange cut line extends perpendicularly outwardly from said ceiling joist/collar beam flange fold line to said soffit vent baffle panel cut line.

15. The panel as defined in claim 14, wherein said first portion of said ceiling joist/collar beam clearance cut line, said one lateral edge of said sheet of material, said ceiling joist/collar beam flange fold line, and said ceiling joist/collar beam flange cut line together define a downwardly foldable ceiling joist/collar beam flange.

16. The panel as defined in claim 15, wherein said removable ceiling joist/collar beam clearance area when removed and said ceiling joist/collar beam flange cut line is cut and said downwardly foldable ceiling joist/collar beam flange is folded perpendicularly downwardly on said ceiling joist/collar beam flange fold line, a ceiling joist/collar beam flange of said multi-function channel is formed;

wherein said ceiling joist/collar beam flange is for abutting against the ceiling joist/collar beam; and wherein said ceiling joist/collar beam clearance notch provides clearance for an associated one of said pair of channel flanges of said multi-function channel.

17. The panel as defined in claim 13, wherein said ceiling joist/collar beam flange fold line is pre-grooved.

18. The panel as defined in claim 11, wherein said second portion of said ceiling joist/collar beam clearance cut line is pre-cut.

19. The panel as defined in claim 6, wherein said soffit vent baffle panel cut line is pre-cut.

20. The panel as defined in claim 5, wherein said at least one soffit vent baffle panel fold line is straight;

wherein said at least one soffit vent baffle panel fold line is parallel to said pair of lateral edges of said sheet of material; and wherein said at least one soffit vent baffle panel fold line is perpendicular to said pair of longitudinal edges of said sheet of material.

21. The panel as defined in claim 5, wherein said pair of channel flange fold lines are pre-grooved; and wherein said at least one soffit vent baffle panel fold line is pre-grooved.

22. The panel as defined in claim 5, wherein said at least one soffit vent baffle panel fold line is pre-scored; and wherein said pair of channel flange fold lines are pre-scored.

23. The panel as defined in claim 5, wherein each channel flange fold line extends continuously from one lateral edge to the other lateral edge of said sheet of material; and wherein at least one soffit vent baffle panel fold line extends continuously from one longitudinal edge to the other longitudinal edge of said sheet of material.

24. The multi-function channel as defined in claim 2, wherein said pair of longitudinal edges of said sheet of material are a pair of long edges;

wherein said pair of lateral edges of said sheet of material are a pair of short edges; and wherein said pair of short edges of said sheet of material are shorter than said pair of long edges thereof, respectively.

25. The panel as defined in claim 2, wherein said sheet of material has an entire length;

wherein said entire length extends from one lateral edge to the other lateral edge of said sheet of material; and wherein each channel flange extends said entire length of said sheet of material.

26. The panel as defined in claim 1, wherein said pair of channel flanges are identical in configuration to each other; and wherein each channel flange is rectangular-shaped.

27. The panel as defined in claim 1, wherein said sheet of material is made of a thermal insulating material.

28. The panel as defined in claim 1, wherein said pair of upwardly foldable channel flanges are folded perpendicularly upwardly on said pair of channel flange fold lines to form said pair of channel flanges of said multi-function channel.

29. The panel as defined in claim 1, wherein said pair of channel flanges define a web therebetween; and wherein said web is flat.

30. A multi-function channel for forming on-site and being self-retaining between, and by, a pair of adjacent and spaced-apart framing members without a need for fasteners, said multi-function channel comprising:

a) a web; and b) a pair of channel flanges;

wherein said pair of channel flanges extend upwardly from said web;

wherein said multi-function channel is made of a slightly compressible material; and wherein said pair of channel flanges have outer surfaces whereby said outer surfaces of said pair of channel flanges are substantially perpendicular to said uppermost surface and are for being abutted against the pair of adjacent and spaced-apart framing members, and when said pair of channel flanges are abutted against the pair of adjacent and spaced-apart framing members, said multi-function channel compresses enough to provide an outward force sufficient to allow said multi-function channel to be self-retaining between, and by, the pair of adjacent and spaced-apart framing members without the need for the fasteners.

31. The multi-function channel as defined in claim 30; further comprising a soffit went baffle panel;

wherein said soffit vent baffle panel is for a soffit vent; and wherein said soffit vent baffle panel depends perpendicularly from said web.

32. The multi-function channel as defined in claim 31; further comprising a pair of baffle flanges; and wherein said pair of baffle flanges extend perpendicularly inwardly from said soffit vent baffle panel.

33. The multi-function channel as defined in claim 32, wherein said soffit vent baffle panel is rectangular-shaped;

wherein said soffit vent baffle panel is flat;

wherein said soffit vent baffle panel has a pair of side edges; and wherein said soffit vent baffle panel has an entire height.

34. The multi-function channel as defined in claim 33, wherein said pair of baffle flanges extend perpendicularly inwardly from said pair of side edges of said soffit vent baffle panel, respectively.

35. The multi-function channel as defined in claim 33, wherein said pair of baffle flanges extend said entire height of said soffit vent baffle panel.

36. The multi-function channel as defined in claim 32, wherein said pair of baffle flanges are identical to each other;

wherein each baffle flange is rectangular-shaped; and wherein each baffle flange is flat.

37. The multi-function channel as defined in claim 32, wherein said web has a lowermost surface;

wherein said pair of baffle flanges abut perpendicularly against said lowermost surface of said web; and wherein said pair of baffle flanges are for abutting against the pair of adjacent and spaced-apart framing members.

38. The multi-function channel as defined in claim 31, wherein said web is flat;

wherein said web is rectangular-shaped;

wherein said web has a pair of longitudinal edges;

wherein said web has a pair of lateral edges;

wherein said web has an entire length;

wherein said entire length of said web extends from one lateral edge thereof to the other lateral edge thereof;

wherein said web has an entire width; and wherein said entire width of said web extends from one longitudinal edge thereof to the other longitudinal edge thereof.

39. The multi-function channel as defined in claim 30, wherein said pair of longitudinal edges of said web are straight;

wherein said pair of longitudinal edges of said web are parallel to each other;

wherein said pair of lateral edges of said web are straight;

wherein said pair of lateral edges of said web are parallel to each other; and wherein said pair of longitudinal edges of said web are perpendicular to said pair of lateral edges of said web.

40. The multi-function channel as defined in claim 38, wherein said pair of channel flanges extend perpendicularly upwardly from said pair of longitudinal edges of said web, respectively.

41. The multi-function channel as defined in claim 38, wherein said pair of channel flanges extend said entire length of said web.

42. The multi-function channel as defined in claim 38, wherein one channel flange extends said entire length of said web;

wherein the other channel flange extends from one lateral edge of said web to a terminal edge;

wherein said terminal edge of said other channel flange is short of the other lateral edge of said web so as to form a ceiling joist/collar beam clearance notch therebetween; and wherein said ceiling joist/collar beam clearance notch provides clearance for said other channel flange.

43. The multi-function channel as defined in claim 42, further comprising a ceiling joist/collar beam flange; and wherein said ceiling joist/collar beam flange depends perpendicularly from said web.

44. The multi-function channel as defined in claim 43, wherein said ceiling joist/collar beam flange is rectangular-shaped;

wherein said ceiling joist/collar beam flange is flat;

wherein said ceiling joist/collar beam flange depends perpendicularly from just inwardly of said longitudinal edge of said web from which said other channel flange extends;

wherein said ceiling joist/collar beam flange extends from just outward of said terminal end of said other channel flange to said other lateral edge of said web; and wherein said ceiling joist/collar beam flange is for abutting against a ceiling joist/collar beam.

45. The multi-function channel as defined in claim 38, wherein said soffit vent baffle panel depends perpendicularly from one lateral edge of said web.

46. The multi-function channel as defined in claim 38, wherein said soffit vent baffle panel extends said entire width of said web.

47. The multi-function channel as defined in claim 38, wherein said pair of longitudinal edges of said web are a pair of long edges;

wherein said pair of lateral edges of said web are a pair of short edges; and wherein said pair of short edges are shorter than said pair of long edges of said web.

48. The multi-function channel as defined in claim 30, wherein said multi-function channel is made of a thermal insulating material.

49. The multi-function channel as defined in claim 30, wherein said pair of channel flanges are identical in configuration to each other;

wherein each channel flange is rectangular-shaped; and wherein each channel flange is flat.

50. The multi-function channel as defined in claim 30, wherein said pair of channel flanges extend perpendicularly upwardly from said web.

* * * * *